US005575866A

United States Patent [19]

Minamida et al.

[11] Patent Number: 5,575,866

[45] Date of Patent: Nov. 19, 1996

[54] HOT ROLLED STEEL WIRE ROD, FINE STEEL WIRE AND TWISTED STEEL WIRE

[75] Inventors: Takaaki Minamida, Tokyo; Kozo Katsube, Kobe; Katsuji Mizutani, Kobe; Mamoru Murahashi, Kobe; Kenji Ochiai, Kobe; Yasuhiro Oki, Kobe; Nobuhiko Ibaraki, Kobe; Tamotsu Shohzaki, Kobe; Yoshihiro Mitani, Kakogawa, all of Japan

[73] Assignee: Kabushiki Kaisha Kobe Seiko Sho, Kobe, Japan

[21] Appl. No.: 565,014

[22] Filed: Nov. 30, 1995

Related U.S. Application Data

[63] Continuation of Ser. No. 153,370, Nov. 16, 1993, abandoned.

[30] Foreign Application Priority Data

| | | | |
|---|---|---|---|
| Nov. 16, 1992 | [JP] | Japan | 4-305488 |
| Apr. 1, 1993 | [JP] | Japan | 5-075765 |
| Sep. 22, 1993 | [JP] | Japan | 5-236578 |

[51] Int. Cl.[6] ..... C22C 38/16; C22C 38/04

[52] U.S. Cl. ..... 148/332; 148/333

[58] Field of Search ..... 420/90, 91, 100; 148/332, 333, 595

[56] References Cited

U.S. PATENT DOCUMENTS 4,960,473 10/1990 Kim et al. .

FOREIGN PATENT DOCUMENTS

| | | |
|---|---|---|
| 0144811 | 6/1985 | European Pat. Off. . |
| 0489159 | 6/1992 | European Pat. Off. . |
| 0493807 | 7/1992 | European Pat. Off. . |

OTHER PUBLICATIONS

Steel in the USSR, vol. 17, No. 12, pp. 569–571, Dec. 1987, A. A. Baranov, et al., "Hardening And Toughness Of Cold Worked Steel Wire".

Patent Abstracts of Japan, vol. 17, No. 79 (C–1027), Feb. 17, 1993, JP–A–4280944, Oct. 6, 1992.

*Primary Examiner*—Deborah Yee

*Attorney, Agent, or Firm*—Oblon, Spivak, McClelland, Maier & Neustadt, P.C.

[57] ABSTRACT

Disclosed are a steel wire rod for manufacturing a fine steel wire excellent in drawability, strength and toughness in which the contents of components such as C, Si, Mn, P, S, Al, Cu are specified, the contents of one or more of elements selected from a group consisting of Cr, W, Ni and Mo are also specified, and in which the balance is essentially Fe and inevitable impurities and for which, the composition of non-metallic inclusions of oxides is also specified; a fine steel wire obtained by drawing of the steel wire rod; and a twisted wire cord made by twisting of the fine steel wires. Further, disclosed is a die schedule for manufacturing the above fine steel wire. Thus, there can be provided a steel wire rod with excellent drawability and which does not break during drawing; a fine steel wire excellent in strength and toughness obtained from the steel wire rod; and a twisted wire cord obtained by twisting together lengths of the fine steel wires.

8 Claims, 1 Drawing Sheet

HOT ROLLED STEEL WIRE ROD, FINE STEEL WIRE AND TWISTED STEEL WIRE

This application is a continuation of application Ser. No. 08/153,370, filed on Nov. 16, 1993, now abandoned.

BACKGROUND OF THE INVENTION

1. Field of the Invention

The present invention relates to a hot-rolled steel wire rod having high drawability and capable of being drawn into a high strength fine steel wire with excellent corrosion resistance; a high strength fine steel wire obtained by drawing of the same steel wire rod and a twisted steel wire obtained by twisting of the same high strength steel wires; and a method of manufacturing the same fine steel wire.

2. Description of the Related Art

A fine steel wire used for a steel cord is generally manufactured in the following procedure: First, a steel material is hot-rolled and is subjected to controlled-cooling. Subsequently, the steel wire rod with a diameter of about 5.0 to 6.4 mm thus obtained is successively subjected to primary drawing, patenting, secondary drawing, re-patenting and brass plating, and then finally wet-drawn into a fine steel wire. A steel cord is manufactured by twisting of the fine steel wires thus obtained. In general, the fine steel wire has a diameter of about 0.35 to 0.175 mm. In the twisting process, several wires or several tens of wires of the fine steel wires are twisted into a steel cord.

In manufacture of such a steel cord, heavy reduction of area of 90 to 98% is applied in the wet-drawing process after brass plating, and further, a torsional stress and a tensile bending stress much stronger than the stress applied during the above wet-drawing process is applied in the subsequent twisting process.

Accordingly, the steel wire rod for the fine steel wire generally requires physical properties capable of preventing the breakage of wire in the subsequent drawing and twisting processes. In particular, for the above-described reason, it is important that the steel wire rod does not cause problems such as the breakage of wire in the wet-drawing process and the subsequent twisting process, and the seizure of a die in the drawing process when the steel wire rod is (to be) mechanically descaled.

In the usual drawing with the help of mechanical descaling, the thicker the scale, the better the drawability in the primary drawing, and accordingly, the hot-rolling conditions are determined so as to obtain thicker scales. However, this method to obtain thicker scale leads to an decrease in the yield ratio of the steel wire rod.

Fine steel wire with a high resistance to delamination is desired in the manufacture of steel cord with a tensile strength exceeding the value calculated by the equation $TS=291-1275\times Log_{10}D$ [$TS(N/mm^2)$: Tensile strength, D(mm): wire diameter of fine steel]. When the tensile strength of the fine steel wire exceeds the value calculated by the above equation, the frequency of delamination in the torsion test sharply increases. If the delamination occurs in the twisting process subsequent to the wet-drawing process, the lay length becomes uneven along the length of the steel cord, thus making it impossible to obtain the normal steel cord.

The steel grade frequently used at present time is SWRH82A prescribed in JIS G 3506. The fine steel wires made from this steel have tensile strengths of about 3400 $N/mm^2$ at 0.2 mm dia., 3200 $N/mm^2$ at 0.3 mm dia. These tensile strengths are set at less than the value obtained from the equation $TS=2650-1275\times Log_{10}D$ [$TS(N/mm^2)$: Tensile strength, D(mm): wire diameter of fine steel]. The present inventors have found that the use of a combination of a special wet-drawing method and addition of special elements into steel is highly effective in preventing delamination.

SUMMARY OF THE INVENTION

An object of the present invention is to provide a hot-rolled steel wire rod of a chemical composition, giving good mechanical descalability to steel wire rod, giving higher tensile strength than the usual levels to fine steel wire, and giving high delamination resistance during the torsion process.

Another object of the present invention is to provide a wet-drawing method for effectively manufacturing a fine steel wire that does not cause any delamination during the above twisting process.

To achieve the above objects, according to the present invention, there is provided a hot-rolled steel wire rod for steel cord containing:

C: 0.85–1.05 wt % (hereinafter, referred to as "%"),

Si: 0.1–0.5%,

Mn: 0.15–0.6%,

P: 0.02% or less,

S: 0.02% or less,

Al: 0.003% or less,

Cu: 0.05–0.20% (not inclusive),

Cr: 0.05–0.6%, and the balance being essentially Fe and inevitable impurities;

wherein the contents of Cr, Si and Cu satisfy the following equation:

$$1.0 \leqq (Cr\%+Si\%)/Cu\% \leqq 4.0$$

The above hot-rolled steel wire rod, preferably, contains Ni: 0.1–0.7% and/or W: 0.05–0.4%.

Furthermore, in the above hot-rolled steel wire rod, the total scale amount after hot-rolling is, preferably, controlled to be in the range of 0.30 to 0.50%; and the center line average roughness (Ra) on the surface of the steel wire rod after being descaled is, preferably, restricted to be 0.55 μm, which makes it possible to reduce the residual scale amount after mechanical descaling, thus resulting in good drawability in the primary drawing process.

In addition, it is preferable that the average composition of non-metallic inclusions mainly consisting of oxides MgO, $SiO_2$, $Al_2O_3$, MnO, CaO and $TiO_2$ is controlled such that the content of $Al_2O_3$ is 30% or less; the content of $SiO_2$ is 70% or less; the combined content of $Al_2O_3$ and $SiO_2$ is in the range 50–90% with the balance mainly consisting of MgO, CaO and $TiO_2$, and that there are no non-metallic inclusions of a Ti(C-N) system with diameters of 10 μm or more detected during microscopic analysis. This makes it possible to further reduce the breakage of wire and the like in the drawing process into the fine steel wire and the twisting process.

The above hot-rolled steel wire rod is subjected to drawing, and subsequently to final heat-treatment and plating; and it is finally drawn with a total reduction of area of 90% or more into a fine steel wire with a diameter of 0.35 mm or less. The fine steel wire thus obtained is excellent in strength and is particularly excellent in corrosion resistance. It is then possible to obtain a steel cord with an excellent performance as a reinforcing material for a tire and the like by twisting several lengths of the fine steel wires. Further, the above hot-rolled steel wire rod is drawn, and is subjected to final heat-treatment and plating; and it is drawn by the wet-drawing process used by the general steel cord makers, to form a fine steel wire. As for the fine steel wires thus obtained, even those with diameters of 0.35 mm or less and with tensile strengths exceeding the value given by the equation $TS=2650-1275\times Log_{10}D$ [D(mm): wire diameter of fine steel wire] ($N/mm^2$) are excellent in toughness and ductility and are particularly excellent in corrosion resistance. To obtain a fine steel wire with a tensile strength exceeding the value given by the equation $TS=2910-1275\times Log_{10}D$ [D(mm): wire diameter of fine steel wire] ($N/mm^2$) or more, a final finish die used in the wet-drawing process is divided into a first finish die and a second finish die wherein the inlet and outlet sides of the first finish die and the inlet side of the second finish die are wet-lubricated, and the outlet side of the second finish die is air-cooled; and wherein the reduction of area of the second finish die is 4–10%. Thus, even by use of the steel wire rod with the above high strength, it is possible to obtain a fine steel wire without delamination by the above wet-drawing method.

BRIEF DESCRIPTION OF THE DRAWINGS

FIG. 1(*b*) is a top view; FIG. 1(*c*) is an explanatory sectional view of main parts; and FIG. 1(*d*) is an explanatory view of a finish die shape.

DETAILED DESCRIPTION OF THE PREFERRED EMBODIMENT

Figure 1A:
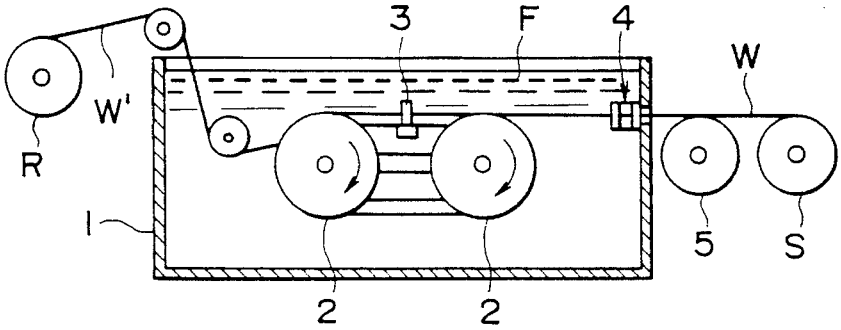
FIGS. 1(*a*) to 1(*d*) are schematic views showing the construction of a wet-drawer used in the wet-drawing of an embodiment of the present invention; wherein FIG. 1(*a*) is a front sectional view.

In the present invention, the composition of the steel material used is specified, to ensure a tensile strength exceeding the value given by the equation $TS=2650-1275\times Log_{10}D$ [D(mm): wire diameter of fine steel wire] ($N/mm^2$) and an excellent corrosion resistance. Further, the adhesion amount of scales formed on a steel wire rod after being hot-rolled is controlled in order to enhance the drawability into a fine steel wire without lowering the production yield so much. In addition, the composition of inevitable impurities contained in the steel wire rod is controlled in order to prevent the breakage of wire during the drawing process or the twisting process.

A fine steel wire with a tensile strength exceeding the value given by the equation $TS=2910-1275\times Log_{10}D$ [D(mm): wire diameter of fine steel wire] ($N/mm^2$), can be manufactured by use of the combination of the composition of the steel material and the improved wet-drawing conditions.

Hereinafter, the requirements of the present invention will be fully described.

First, the reason why the quantity of each component is controlled in the present invention will be described. For enhancing the twisting number in the twisting process while ensuring a sufficient strength for a fine steel wire, it is required to enhance the tensile strength of the patenting material, to reduce the total reduction of area during the wet-drawing process, and to specify the composition of increasing a rate of work hardening in the drawing. Thus, by satisfying the above requirements, it is possible to manufacture a fine steel wire with a tensile strength exceeding the value given by the equation $TS=2650-1275\times Log_{10}D$ [D(mm): wire diameter of fine steel wire] ($N/mm^2$). In the present invention, while such a tensile strength is substantially taken as the aimed reference value, the composition is specified as follows:

C: 0.85–1.05%

In general, the strength of a steel wire rod is enhanced with an increase in the content of C. To ensure the above aimed strength, C must be present in an amount of 0.85% or more. However, C tends to become segregated, and accordingly, as the content of C is excessively increased, center segregation occurs, which often causes the breakage of wire during the wet-drawing process. In particular, when the content of C is in excess of 1.05%, network cementites are generated at austenite grain boundaries during the final patenting process or the direct patenting process after hot-rolling, which tends to cause the breakage of wire in the subsequent drawing process, and also, to remarkably degrade the toughness and ductility of the fine steel wire produced after wet-drawing. Accordingly, in the present invention, the content of C is specified to be in the range of from 0.85 to 1.05%, preferably, in the range of from 0.85 to 1.00%.

Si: 0.1–0.5%

Si is an element necessary for the deoxidation of steel. In particular, since Al is not present in the steel material of the present invention, Si must be present in an amount of at least 0.1% or more. However, when Si is excessively present, drawing becomes difficult during the drawing process by mechanical descaling, and further, it is difficult to achieve sufficient austenitizing during the patenting process as a result of the increase of the $A_3$ transformation point due to the addition of Si, thus tending to cause the breakage of wire during the final wet-drawing process. Further, the excessive addition of Si degrades the weldability of steel, which deteriorates the workability of weld-joining during manufacture of a steel cord and often causes the breakage of wire at the joint portion. Accordingly, the upper limit of the content of Si is specified to be 0.5%. Preferably, the content of Si is in the range of from 0.15 to 0.30%.

Mn: 0.15–0.6%

Mn is an element necessary for accelerating the deoxidation in the steel-making process. When Al is not positively added but is inevitably mixed just as in the present invention, it is essential to add not only Si but also Mn. Further, Mn has the effect of fixing S to form MnS thus enhancing the toughness and ductility of steel. For achieving these effects, Mn must be added in an amount of 0.15% or more. However, Mn though effective in increasing the hardenability is easily segregated. Accordingly, the addition of Mn in excess of 0.6% results in segregation, which brings about a fear of martensites forming at the segregated portions, resulting in generated cuppy-like breakage. Further, Mn is an important element for transforming the composition of non-metallic inclusions of oxides, which cause the breakage of wire during the wet-drawing process and the twisting process, into the complex composition with high ductility described later. Consequently, just enough Mn must be added, and is specified to be in the range of from 0.15 to 0.6%.

P, S: 0.02% or less for each element

To prevent the breakage of wire during the twisting process, it is important to suppress the propagation of micro-cracks generated during the drawing process since they cause breakage of wire, and also to enhance the toughness and ductility of the steel wire rod by reduction of the contents of P and S. Further, in the case that the content of S is added excessively, MnS generated by the reaction between S and Mn is exposed to a corrosive atmosphere, functions as a cathode to form a local cell, thereby accelerating the corrosion of the steel. Accordingly, it is desirable that the contents of S and P are both reduced, and therefore, in the present invention, the contents of S and P in the steel are each specified to be 0.02% or less, preferably, to be 0.01% or less.

Al: 0.003% or less

Al is a main element of non-metallic inclusions of oxides mainly containing $Al_2O_3$ such as $Al_2O_3$, $MgO\text{-}Al_2O_3$ which are one of the main causes of the breakage of wire during manufacture of the fine steel wire or the twisting process of the fine steel wire. The non-metallic inclusions of oxides exert an adverse effect on the service life of a die in the final wet-drawing process, and further, degrade the fatigue characteristic of the fine steel wire and the twisted steel cord. Accordingly, in the present invention, to prevent the breakage of wire due to the non-metallic inclusions of oxides, and to prevent the harmful effect described above, the content of Al is specified to be 0.003% or less.

Cu: 0.05–0.20% (not inclusive)

Cu is effective for enhancing the corrosion resistance of a fine steel wire. When the content of Cu is less than 0.05%, the effect cannot be achieved. As the content of Cu is increased over the 0.05%, the corrosion resistance is enhanced. Further, by the addition of Cu, the drawability by mechanical descaling is improved, and the seizure of a die is effectively prevented.

However, when Cu is added in an amount of 0.20% or more, blisters are generated on the surface of the steel wire rod even at the placing temperature of 900° C. after hot-rolling, and magnetites are generated on the base material under the blisters, which degrade the life of a die used in the drawing by mechanical descaling. In the worst case, the magnetites are extensively generated, and the seizure of the die occurs even at the beginning stage of the drawing.

Cu reacts with S, to generate CuS. CuS segregates at grain boundaries, to generate flaws in a steel ingot and a steel wire rod during the process of manufacturing the steel wire rod, thus causing the breakage of wire during the final wet-drawing process and the twisting process, resulting in reduced productivity. For the content of Cu of 0.20% or more, the above problem becomes significant. Accordingly, in the present invention, the content of Cu is specified to be in the range of from 0.05 to 0.20% (not inclusive), preferably, in the range of from 0.1 to 0.20% (not inclusive). The addition effect of Cu is disclosed in Unexamined Patent Publication No. HEI 4-280944, wherein the added amount of Cu is specified to be in the range of from 0.20 to 0.80%. In this document, however, as the addition effect of Cu, only the improvement in the corrosion fatigue characteristic is disclosed, and the effect on drawability by mechanical descaling, an extremely important feature in the manufacture of a fine steel wire, is not examined.

Cr: 0.05–0.6%

Cr is effective for enhancing the rate of work hardening during the final patenting process or the wet-drawing process after plating. Under the allowable reduction, that is, under a true strain in the final drawing by a drawer, the addition of Cr in a suitable amount makes it possible to obtain a high strength steel wire. Namely, Cr is an extremely important element for enhancing the rate of work hardening for manufacturing a high strength steel wire. The effects of Cr can be achieved by the addition of Cr in an amount of 0.05% or more. When the content of Cr is in excess of 0.6%, the hardenability of steel is excessively increased, which makes it difficult to perform the final patenting process, and further, deteriorates the mechanical descalability. Accordingly, the addition of Cr must be suppressed to be 0.6% or less. Preferably, the content of Cr is specified to be in the range of from 0.1 to 0.3%.

As described above, Cr is an essential element for enhancing the strength of the steel. However, the excessive addition of Cr degrades the mechanical descalability. On the contrary, Cu has the effect of improving the mechanical descalability; however, the excessive addition of Cu causes blisters on scales which tends to deteriorate the mechanical descalability. Further, as described above, it is recognized that the addition of Si degrades the mechanical descalability. Accordingly, to achieve the improvement of both the high strengthening and the mechanical descalability, the suppression of the total content of Cr, Cu and Si is considered to be important. Thus, the present inventors have further examined, and confirmed the following fact: namely, by specifying the respective contents of three elements such that they satisfy the relationship of $1.0 \leqq (Cr\%+Si\%)/Cu\% \leqq 4.0$, the high strength steel wire can be obtained without deteriorating the mechanical descalability. In addition, when the value is less than 1.0%, it is impossible to suppress the generation of blisters, thus degrading the drawability. On the otherhand, when the value becomes excessively large, drawing becomes very difficult because of the presence of residual scales left after the mechanical descaling.

Ni: 0.1–0.7% and/or W: 0.05–0.4%

Ni is effective for enhancing the toughness and ductility, particularly, the twisting characteristic of a fine steel wire. The effect of Ni can be achieved by the addition of Ni in an amount of 0.1% or more. However, when Ni is excessively added, the hardenability of steel is excessively increased and it is difficult to perform the patenting process in the manufacture of the fine steel wire. Consequently, the content of Ni must be restricted to be 0.7% or less.

Further, similarly to Cr, the content of W in an amount of 0.05% or more significantly increases the rate of work hardening, to thereby enhancing the strength of the steel wire. However, when the content of W reaches 0.4%, the above effect is saturated, so that any further addition is wasteful. Further, when W is added in excess of 0.4%, the hardenability is excessively increased, and it is difficult to perform the final patenting process. The content of W is, preferably, specified to be in the range of from 0.1 to 0.2%.

The steel wire rod according to the present invention contains components, which satisfy the above requirements, with the balance being essentially Fe and inevitable impurities. The inevitable impurities contain N, Ti, Nb and the like in trace amounts, as well as non-metallic inclusions of oxides described later. These inevitable impurities are, preferably, suppressed as much as possible.

During the manufacture of the steel wire rod having the above composition, first, a steel material is hot-rolled to a steel wire rod with a diameter of 5 to 6.5 mm. Subsequently, scales on the surface of the steel wire rod are removed by mechanical descaling or picking descaling. For the removal of scales by mechanical descaling, the surface roughness of the steel wire rod after hot-rolling becomes an important factor with respect to the scale releasability. As the surface of the steel wire rod is coarsened, the amount of scales is increased, which brings about a problem of the occurrence of the seizure of a die in the subsequent drawing process. Accordingly, in the present invention, the upper limit of the surface roughness is specified to be 0.55 μm in Ra. The center line average roughness defined here is expressed as the value in terms of micro-meter calculated by the following equation:

$$Ra=\frac{1}{L}\int_0^L |f(x)|dx$$

wherein the center line of the portion of a measured length of rod L sampled from a roughness curve in the center line direction is taken as the X-axis, and the axial magnification direction is taken as a Y-axis, and where the roughness curve is expressed by y=f(x).

In the case that scales are removed by picking descaling, care need only be taken to avoid the generation of rust during the transport of a steel wire rod, and accordingly, the scale adhesion amount is not required to be taken into account. However, in the case that the removal of scales and the drawing are simultaneously performed by a mechanical descaler, the adhesion amount of scales on the surface of a steel wire rod exerts an extremely large effect on the drawing.

Namely, when the adhesion amount of scales on the surface of a steel wire rod is large, the amount of residual scales on the surface of the steel wire rod after removal of scales by the mechanical descaler is relatively made small, so that the subsequent drawing is made relatively easy; however, the yield is reduced because of the large amount of the scales. Accordingly, in the present invention, in consideration of the yield, the upper limit of the adhesion amount of scales is specified to be 0.50%.

On the contrary, when the adhesion amount of scales on the surface of the steel wire rod is reduced, the amount of residual scales after mechanical descaling is increased, so that there often occurs troubles such as the seizure of a die during the subsequent drawing process, which significantly degrades the drawability. The limit for the amount of scales is generally regarded as about 0.45%. However, in the present invention, since the preferable scale releasing can be achieved even with a scale amount of 0.30%, the lower limit of the scale adhesion amount is specified to be 0.30%.

In addition, the surface roughness of a steel wire rod and the scale adhesion amount become a problem when scales are removed by mechanical descaling as described above, and they do not particularly become a restriction factor in the case that scales are removed by pickling descaling.

The non-metallic inclusions of oxides inevitably present in the steel will be described below.

As described above, in the reason for restricting the content of Al, non-metallic inclusions such as $Al_2O_3$, MgO-$Al_2O_3$, TiN and $SiO_2$ are present in a steel wire rod in trace amounts. Among these inclusions, those with non-ductility cause the breakage of wire during the subsequent cold working, or exert adverse effect on the fatigue characteristic, and consequently should be reduced as much as possible. Further, it is desirable that the characteristic of extendability during the hot-rolling is given to the inclusions.

The composition of the non-metallic inclusions is dependent on impurities mixed from subsidiary raw materials, elements mixed due to the melting loss of refractories, and on the equilibrium state with the slag composition and the like. In the steel wire rod of the present invention having a composition of satisfying the above requirements, non-metallic inclusions of oxides mainly contain MgO, $SiO_2$, $Al_2O_3$, MnO, CaO and $TiO_2$ wherein the average composition as revealed by an analysis of oxide forms of the non-metallic inclusions of oxides, is specified in that the content of $Al_2O_3$ is 30% or less; the content of $SiO_2$ is 70% or less; and the total contents of $Al_2O_3$ and $SiO_2$ are in the range of from 50 to 90%, the balance being MgO, CaO and $TiO_2$. It is revealed that the steel wire rod containing the above inclusions makes it possible to reduce the breakage of wire in the drawing into a fine steel wire and during the subsequent twisting, and exhibits the excellent fatigue characteristic. The reason for this is that, since the non-metallic inclusions satisfying the above requirements adopt a structure which is relatively extended during hot-rolling, they do not exert an adverse effect on the drawing in the cold-state.

Conversely, for non-metallic inclusions of oxides containing $Al_2O_3$ in an amount of 30% or more, there often exist $Al_2O_3$ and MgO-$Al_2O_3$ surrounded by silicates. The silicates are extended in hot-rolling or are finely broken in the drawing process, and thereby they do not exert adverse effect on the subsequent drawability. However, the remaining $Al_2O_3$ and MgO-$Al_2O_3$, which remain even after formation of the fine steel wire are non-extendable, thus causing the breakage of wire. Further, when the content of $SiO_2$ exceeds 70%, the ductility of the non-metallic inclusions of oxides as a whole is reduced, and thus the non-metallic inclusions of oxides are not broken during the drawing process into a fine steel wire so much, which often exerts an adverse effect on the fatigue characteristic.

Further, the total amount of $SiO_2$ and $Al_2O_3$ should be in the range of from 50 to 90%. When less than 50%, non-metallic inclusions rich in CaO are generated. The non-metallic inclusions thus generated do not exert such a great adverse effect on the breakage of wire in manufacture of the steel cord; however, they cause fatigue failure. Accordingly, the generation of the above non-metallic inclusions must be avoided. Conversely, when greater than 90%, the composition of the non-metallic inclusions becomes rich in $Al_2O_3$ or $SiO_2$, which causes the breakage of wire during manufacture of the steel cord or fatigue failure. Either case is out of the gist of the present invention.

In addition, non-metallic inclusions of Ti system, particularly, TiN, TiC or the complex inclusions thereof, that is, Ti(C, N) are harmful with respect to the breakage of wire during manufacture of the steel cord. In particular, inclusions having sizes exceeding 10 μm become a major cause of the breakage of wire. Accordingly, it is required that the non-metallic inclusions of Ti(C, N) of the above sizes, must not be present to any substantial degree when the optical microscopic inspection of 10 to 20 pieces of steel wire rod is made.

Next, a method of preventing the delamination of a fine steel wire will be described.

As described above, when the tensile strength of a fine steel wire has a value exceeding that given by the equation $TS=2910-1275\times Log_{10}D$ [D(mm): wire diameter of fine steel wire] ($N/mm^2$), delamination tends to occur during the torsion test of the fine steel wire. To prevent the delamination of the fine steel wire, it is important to use a composition of the steel suitable for the wet-drawing process. However, since the wet-drawing conditions exert a large effect on the delamination of the fine steel wire, it is further important to control the wet-drawing conditions in order to manufacture a fine steel wire with high strength and high ductility. To give a tensile strength exceeding the value given by the equation, $TS=2910-1275\times Log_{10}D$ [D(mm): wire diameter of fine steel wire] ($N/mm^2$) to the fine steel wire, it is required to apply a drawing reduction of area of 95% or more to the steel wire rod. On the other hand, in the usual drawing equipment, since the difference in the reduction of area between successive dies is restricted, when the drawing reduction of area is increased, it is required to enlarge the reduction of area of the finish die if the drawing reduction of area is set to be higher. Further, in the wet-drawing for a fine steel wire used for a tire cord, there is the further restriction that the outlet of a finish die be air-cooled. The present inventors have examined these restriction conditions, and have devised the following drawing method. Namely, the finish die is divided into two dies, to thus form a double die structure. Thus, while the finish drawing is performed with a specified reduction of area (for example, 12 to 18%) using the double dies, the inlet and the outlet sides of the first finish die and the inlet side of-the second finish die are wet-lubricated. With this drawing method, even when the outlet side of the second finish die is air-cooled, by using the wet-lubrication effect of the first finish die during the wet-drawing, it is possible to prevent the embrittlement of the steel wire due to strain aging by suppressing the drawing temperature of the first finish die.

Next, the effects of the reductions of area and the approach angles of the divided finish dies on the delamination of a fine steel wire will be described.

The approach angles of the first and second dies are set at 12 degrees, and the reductions of area of the first and second finish dies are set constant at 15% in total. Under these conditions, the reductions of area of the first and second finish dies are adjusted in harmony, for example, the reduction area of the first finish die is gradually increased, while the reduction of area of the second finish die is reduced, as a result of which it is found that the delamination does not occur even for a fine steel wire having a tensile strength exceeding the value given by the equation $TS=2910-1275\times Log_{10}D$ [D(mm): wire diameter of fine steel wire] ($N/mm^2$) for conditions in which the reduction of area of the second finish die is 7.5% or less. Further, the drawing experiment is performed with the condition that the approach angle of the first finish die is set at 12 degrees, the approach angle of the second finish die is set at a value between 4 to 8 degrees, and the reduction of area of the second finish die is set at a value between 4 to 10%. The result of the experiment is that, when the approach angle of the second finish die is 5 degrees and the reduction of area of the second finish die is about 4%, it is possible to obtain a fine steel wire with a tensile strength of 4100 $N/mm^2$ without any delamination. Thus, the finish die is divided into the first and second dies; the inlet and outlet sides of the first finish die and the inlet side of the second finish die are wet-lubricated to suppress the working heat generation; and the reduction of area of the second finish die is set to be in the range of from 4 to 10%, which makes it possible to obtain the fine steel wire with a tensile strength exceeding the value given by the equation $TS=2910-1275\times Log_{10}D$ [D(mm): wire diameter of fine steel wire] ($N/mm^2$) without any delamination. Further, as necessary, by use of a second finish die with an approach angle smaller than the 12° angle of the usual die, it is possible to further enhance the prevention of the delamination.

The steel wire rod of the present invention can be manufactured by hot-rolling a steel material having a composition satisfying the above requirements, followed by controlled-cooling. In general, the steel wire rod has a diameter in the range of from 5.0 to 6.4 mm, and is then subjected to drawing and patenting in the usual manner, and if necessary, to brass plating, or zinc plating, after which it is wet-drawn into a fine steel wire.

The fine steel wire thus obtained exhibits a high strength and is excellent in drawability by mechanical descaling, and which may be effectively used as the excellent reinforcing wire material by itself. Further, a steel cord obtained by twisting of several or several tens of lengths of the fine steel wires is widely used as a reinforcing material for a tire, belt and cord.

The present invention will be described more fully by way of the following examples; however, the examples do not restrict the present invention.

Steel materials having compositions as shown in Tables 1 and 2 were hot-rolled (the placing temperature after hot-rolling: 950° C.) and were subjected to controlled cooling and direct patenting, to thus obtain steel wire rods having a diameter of 5.5 mm. Each of the steel wire rods was subjected to mechanical descaling, and the center line average roughness (Ra) on the surface of the steel wire rod after scale releasing and the amount of scales remaining on the surface of the steel wire rod were measured.

The steel wire rod was drawn, and was evaluated for the drawability by gradually increasing the drawing rate and determining the limit drawing rate at which seizure occurred in the die.

To evaluate the mechanical properties of a fine steel wire, the steel wire rod with a diameter of 2.2 mmø was subjected to lead patenting, and then drawn to a diameter of 1.40 mmø, and then subjected to lead patenting again and to brass plating, after which it was wet-drawn into a fine steel wire with a diameter of 0.23 mmø. The fine steel wires thus obtained were twisted, to form a steel cord. The results are shown in Tables 3 and 4.

TABLE 1

| | Chemical composition (wt %) | | | | | | | | | (Cr % + |
|---|---|---|---|---|---|---|---|---|---|---|
| Symbols | C | Si | Mn | P | S | Cu | Cr | W | AL | Si%)/Cu % |
| Comparative Example | | | | | | | | | | |
| A | 0.80 | 0.30 | 0.55 | 0.015 | 0.008 | 0.01 | 0.01 | tr. | 0.002 | 31.0 |
| B | 0.89 | 0.18 | 0.50 | 0.013 | 0.010 | 0.02 | 0.23 | tr. | <0.002 | 10.3 |
| C | 0.92 | 0.41 | 0.50 | 0.010 | 0.009 | 0.23 | 0.22 | tr. | <0.002 | 2.7 |
| D | 0.87 | 0.18 | 0.20 | 0.005 | 0.003 | 0.30 | 0.19 | tr. | <0.002 | 1.1 |
| Inventive Example | | | | | | | | | | |
| E | 0.93 | 0.18 | 0.33 | 0.005 | 0.005 | 0.17 | 0.49 | tr. | <0.002 | 3.9 |
| F | 0.92 | 0.18 | 0.33 | 0.006 | 0.004 | 0.18 | 0.23 | tr. | <0.002 | 2.2 |
| G | 0.98 | 0.23 | 0.50 | 0.010 | 0.003 | 0.16 | 0.30 | tr. | <0.002 | 3.3 |
| H | 1.03 | 0.20 | 0.35 | 0.007 | 0.003 | 0.13 | 0.25 | tr. | <0.002 | 3.5 |

TABLE 2

| Symbols | Chemical composition (wt %) C | Si | Mn | P | S | Cu | Ni | Cr | W | AL | (Cr % + Si%)/Cu % |
|---|---|---|---|---|---|---|---|---|---|---|---|
| Comparative Example | | | | | | | | | | | |
| M | 0.90 | 0.25 | 0.50 | 0.010 | 0.008 | 0.01 | 0.01 | 0.25 | 0.01 | <0.002 | 50.0 |
| N | 0.85 | 0.32 | 0.53 | 0.016 | 0.006 | 0.42 | 0.01 | 0.08 | 0.01 | <0.002 | 0.95 |
| Inventive Example | | | | | | | | | | | |
| O | 0.92 | 0.18 | 0.35 | 0.011 | 0.004 | 0.18 | 0.30 | 0.23 | 0.01 | <0.002 | 1.2 |
| P | 0.87 | 0.16 | 0.28 | 0.018 | 0.013 | 0.15 | 0.50 | 0.19 | 0.18 | <0.002 | 2.3 |
| Q | 1.02 | 0.20 | 0.33 | 0.008 | 0.006 | 0.19 | 0.68 | 0.30 | 0.01 | <0.002 | 3.3 |
| R | 0.91 | 0.18 | 0.40 | 0.009 | 0.009 | 0.08 | 0.01 | 0.11 | 0.39 | <0.002 | 3.6 |
| S | 1.02 | 0.18 | 0.40 | 0.009 | 0.007 | 0.11 | 0.11 | 0.18 | 0.01 | <0.002 | 3.3 |
| T | 0.93 | 0.19 | 0.41 | 0.011 | 0.006 | 0.13 | 0.01 | 0.15 | 0.20 | <0.002 | 2.6 |
| U | 0.86 | 0.21 | 0.33 | 0.015 | 0.011 | 0.13 | 0.55 | 0.25 | 0.25 | <0.002 | 3.5 |
| V | 1.02 | 0.18 | 0.53 | 0.012 | 0.006 | 0.01 | 0.01 | 0.01 | 0.01 | <0.002 | 19.0 |

TABLE 3

| Symbols | Mechanical properties of fine steel wire: Tensile strength ($N/mm^2$) | Reduction of area (%) | Presence or absence of blister | Mechanical descalability and drawability: Residual scale amount after mechanical descaling (%) | Seizure limit drawing rate (m/min) |
|---|---|---|---|---|---|
| Comparative Example | | | | | |
| A | 3208 | 44 | Absence | 0.023 | 300 |
| B | 3513 | 42 | Absence | 0.040 | <260 |
| C | 3703 | 42 | Presence | 0.021 | 280 |
| D | 3604 | 41 | Presence | 0.019 | <260 |
| Inventive Example | | | | | |
| E | 3713 | 40 | Absence | 0.016 | 340 |
| F | 3800 | 37 | Absence | 0.016 | 370 |
| G | 3906 | 36 | Absence | 0.009 | 380 |
| H | 4018 | 35 | Absence | 0.017 | 360 |

Mechanical properties of a fine steel wire of 0.23 mmø; a limit drawing rate at which seizure of the die does not occur during a process of drawing a steel wire rod from 5.5 mmø to 2.2 mmø by mechanical descaling; and presence or absence of blister

TABLE 4

| Symbols | Mechanical properties of fine steel wire: Tensile strength ($N/mm^2$) | Reduction of area (%) | Presence or absence of blister | Mechanical descalability and drawability: Residual scale amount after mechanical descaling (%) | Seizure limit drawing rate (m/min) |
|---|---|---|---|---|---|
| Comparative Example | | | | | |
| M | 3788 | 28 | Absence | 0.040 | <260 |
| N | 3334 | 41 | Absence | 0.031 | 260 |
| Inventive Example | | | | | |
| O | 3718 | 43 | Absence | 0.013 | 350 |
| P | 3718 | 45 | Absence | 0.018 | 340 |
| Q | 4018 | 40 | Absence | 0.020 | 340 |
| R | 3981 | 39 | Absence | 0.019 | 350 |
| S | 3886 | 37 | Absence | 0.013 | 370 |

TABLE 4-continued

| Symbols | Mechanical properties of fine steel wire: Tensile strength ($N/mm^2$) | Reduction of area (%) | Presence or absence of blister | Mechanical descalability and drawability: Residual scale amount after mechanical descaling (%) | Seizure limit drawing rate (m/min) |
|---|---|---|---|---|---|
| T | 3899 | 39 | Absence | 0.018 | 350 |
| U | 3681 | 41 | Absence | 0.020 | 380 |

Mechanical properties of a fine steel wire of 0.23 mmø; a limit drawing rate at which seizure of the die does not occur during a process of drawing a steel wire rod from 5.5 mmø to 2.2 mmø by mechanical descaling; and presence or absence of blister From the results as shown in Tables 1 to 4, the following will become apparent:

Tables 1 and 3 show the results obtained by drawing by mechanical descaling and the mechanical properties of the final fine steel wires. In these Tables, Comparative Example A is lacking in the content of Cr, so that there cannot be obtained a fine steel wire with a tensile strength exceeding the value given by the equation $TS=2650-1275\times Log_{10}D$ [D(mm): wire diameter of fine steel wire] ($N/mm^2$). Further, the residual scale amount after mechanical descaling does not satisfy the requirement of being 0.020% or less required for providing good drawability. However, drawing at a low drawing rate of about 300 m/min is possible.

Comparative Example B contains Cr in a suitable amount, so that there can be obtained a fine steel wire with a tensile strength exceeding the value given by the equation $TS=2650-1275\times Log_{10}D$ [D(mm): wire diameter of fine steel wire] ($N/mm^2$). However, the ratio (Cr%+Si%)/Cu% exceeds the specified range, and as a consequence the mechanical descalability becomes worse due to the addition of Cr, thus making it impossible to perform drawing even at the minimum drawing rate of the drawing equipment used in this experiment.

In Comparative Example C, (Cr%+Si%)/Cu% has the value of 2.7, which is within the specified range of from 1 to 4; but the absolute value of the Cu content exceeds 0.20%, and consequently blisters are generated. Because of the blisters thus generated, the seizure limit drawing rate is reduced. The same is true for Comparative Example D. Namely, in Comparative Example D, the residual scale amount is not so much larger; however, the seizure limit drawing rate does not even reach the value of 260 m/min.

However, for each of the hot-rolled steel wire rods (E and F) of the present invention, which are controlled to contain Cu and Cr in suitable amounts, to specify (Cr%+Si%)/Cu% to be in the range of from 1 to 4, and to contain Cu in an amount of less than 0.20%, the scale releasability is improved by the addition of Cu, and the high strength fine steel wire can be easily manufactured by the addition of Cr. This makes it possible to obtain the fine steel wire with a high strength of $2650-1275\times Log_{10}D$ [D(mm): wire diameter of fine steel wire] ($N/mm^2$) or more while maintaining the preferable level of drawability during mechanical descaling. In addition, the residual scale amount is preferred to be 0.02% or less.

Tables 2 and 4 shows the effect of adding Ni and/or W. Comparative Example M is a Cr added material similar to Comparative Example B shown in Table 1. Comparative Example N is a steel in which Cu has been added in a large amount.

As is apparent from Table 4, Comparative Example M is worse with respect to drawability by mechanical descaling. Further, for Comparative Example N, the drawing by mechanical descaling can be performed with difficulty, that is, at a low drawing rate of less than 300 m/min. In either of these two Comparative Examples, the residual scale rate exceeds 0.030%. In particular, for Comparative Example N, the relationship between Cu% and (Cr%+Si%) is unbalanced, thereby causing the generation of blisters on scales, as a result of which sub-scales are generated, thus extremely degrading the drawability.

In contrast, each of Inventive Examples O to U ensures preferable drawability by mechanical descaling. As for the characteristics of the fine steel wire, each of Inventive Examples O, R and S containing Ni in a suitable amount has a strength exceeding the value given by the equation $TS=2910-1275\times Log_{10}D$ [D(mm): wire diameter mm of fine steel wire] ($N/mm^2$); notwithstanding, it exhibits a preferable reduction value. Even for each of Inventive Examples R and T containing W, a fine steel wire with high strength is obtained. In addition, in each of Inventive Examples P and U containing W and Ni, a fine steel wire with high strength and high ductility is obtained.

As described above, it is apparent that the addition of Ni and W is extremely effective for obtaining a fine steel wire with high strength and high ductility.

Table 5 shows the results of the experiments in which the surface roughness of the steel wire rod, the residual scale amount and the behavior during the drawing are examined by use of Comparative Examples A to D and Inventive Examples E to H.

As is apparent from Table 5, for each of Comparative Examples A and B, the surface roughness of the steel wire rod is bad (0.65 μm), and accordingly, the residual scale amount is increased and the seizure limit drawing rate is very low (300 m/min or less). On the contrary, for Inventive Examples E to H, Cu and Cr are added in suitable amounts and (Cr%+Si%)/Cu% is controlled to be in the range of from 1 to 4, and the result is that the surface roughness is small, and the scale releasability is improved, thereby increasing the seizure limit drawing rate.

TABLE 5

| Symbols | Residual scale amount after mechanical descaling (%) | Center line average roughness on steel wire rod surface: Ra (μm)* | Seizure limit drawing rate (m/min) |
|---|---|---|---|
| Comparative Example | | | |
| A | 0.023 | 0.65 | 300 |
| B | 0.040 | 0.76 | <260 |
| Inventive Example | | | |
| E | 0.016 | 0.50 | 340 |

TABLE 5-continued

| Symbols | Residual scale amount after mechanical descaling (%) | Center line average roughness on steel wire rod surface: Ra (μm)* | Seizure limit drawing rate (m/min) |
|---|---|---|---|
| F | 0.016 | 0.35 | 370 |
| G | 0.009 | 0.20 | 380 |
| H | 0.017 | 0.37 | 360 |

*Center line average roughness on the surface of a hot-rolled steel wire rod measured after descaling with an applied tensile strain of 4%

Table 6 shows the test steels used for the experiment of examining the behavior during the drawing for different thicknesses of scales formed upon hot-rolling. In this experiment, by use of Comparative Examples W and X, and Inventive Examples Y and Z, the thicknesses of scales on the hot-rolled steel wire rods were varied in the range from 0.20 to 0.70%. The mechanical descalability and the drawability of each steel wire rod was examined in the same manner as described above, and the results are shown in Table 7.

TABLE 7-continued

| Symbols | Mechanical descalability and drawability: Residual scale amount after mechanical descaling (%) | Seizure limit drawing rate (m/min) |
|---|---|---|
| 4 | 0.081 | <260 |
| 5 | 0.045 | <260 |
| 6 | 0.029 | 300 |
| Inventive Example Y | | |
| 7 | 0.048 | <260 |
| 8 | 0.027 | 320 |
| 9 | 0.013 | 370 |
| 10 | 0.012 | 370 |
| Inventive Example Z | | |
| 11 | 0.053 | <260 |

TABLE 6

| Symbols | Chemical composition (wt %) C | Si | Mn | P | S | Cu | Ni | Cr | W | Al | (Cr % + Si %) /Cu% | Total scale amount of rolled material (%) |
|---|---|---|---|---|---|---|---|---|---|---|---|---|
| Comparative Example W | | | | | | | | | | | | |
| 1 | | | | | | | | | | | | 0.31 |
| 2 | 0.92 | 0.18 | 0.55 | 0.015 | 0.008 | 0.02 | 0.01 | 0.01 | tr. | ≦0.002 | 9.5 | 0.55 |
| 3 | | | | | | | | | | | | 0.70 |
| Comparative Example X | | | | | | | | | | | | |
| 4 | | | | | | | | | | | | 0.33 |
| 5 | 0.93 | 0.22 | 0.40 | 0.016 | 0.006 | 0.01 | 0.01 | 0.19 | tr. | ≦0.002 | 41.0 | 0.48 |
| 6 | | | | | | | | | | | | 0.65 |
| Inventive Example Y | | | | | | | | | | | | |
| 7 | | | | | | | | | | | | 0.20 |
| 8 | 0.92 | 0.23 | 0.38 | 0.015 | 0.010 | 0.15 | 0.01 | 0.23 | tr. | ≦0.002 | 3.1 | 0.32 |
| 9 | | | | | | | | | | | | 0.45 |
| 10 | | | | | | | | | | | | 0.53 |
| Inventive Example Z | | | | | | | | | | | | |
| 11 | | | | | | | | | | | | 0.23 |
| 12 | 0.93 | 0.18 | 0.33 | 0.011 | 0.009 | 0.23 | 0.40 | 0.23 | tr. | ≦0.002 | 1.8 | 0.35 |
| 13 | | | | | | | | | | | | 0.49 |
| 14 | | | | | | | | | | | | 0.57 |
| 15 | | | | | | | | | | | | 0.68 |

TABLE 7

| Symbols | Mechanical descalability and drawability: Residual scale amount after mechanical descaling (%) | Seizure limit drawing rate (m/min) |
|---|---|---|
| Comparative Example W | | |
| 1 | 0.067 | <260 |
| 2 | 0.028 | 300 |
| 3 | 0.020 | 360 |
| Comparative Example X | | |

TABLE 7-continued

| Symbols | Mechanical descalability and drawability: Residual scale amount after mechanical descaling (%) | Seizure limit drawing rate (m/min) |
|---|---|---|
| 12 | 0.023 | 340 |
| 13 | 0.019 | 360 |
| 14 | 0.014 | 370 |
| 15 | 0.015 | 370 |

In viewpoint of the scale releasability of Comparative Example W in Tables 6 and 7, the seizure limit drawing rate is very bad (less than 260 m/min) when the total scale amount of the rolled material is 0.31%; however, as the total scale amount is increased to 0.55%, and further, to 0.70%, the residual scale amount is reduced, and the seizure limit drawing rate is thereby improved. Further, for Comparative Example X, the addition of Cr degrades the scale releasability by mechanical descaling, such that drawing cannot be performed at all until the total scale amount reaches the value of 0.48%. Drawing becomes possible when the total scale amount reaches the value of 0.65%, but even then only at a drawing rate of 290 m/min.

On the other hand, in each of Inventive Examples Y and Z, when the total scale amount of the rolled steel wire is between 0.20% to 0.30%, the drawability is not very good, but when the scale amount is 0.30% or more, the stable drawability can be ensured. As is apparent from the results, for the steel materials of the present invention, even when the scale amount of the rolled materials is in the range of from 0.30 to 0.50%, it is possible to ensure preferable mechanical descalability and subsequent good drawability.

Table 8 shows the relationship between the compositions of non-metallic inclusions, specifically, non-metallic inclusions of oxides in steels; details of the steels in which the number of non-metallic inclusions of Ti(C, N) system are controlled; and the breakage numbers during the process of drawing into fine steel wires. Symbols a to e show the steels in which the content of $Al_2O_3$ is 30% or more, or in which the content of $SiO_2$ is 70% or more. Symbols f to i show the steels in which the content of $Al_2O_3$ is 30% or less, the content of $SiO_2$ is 70% or less, and the total amount of $Al_2O_3$ and $SiO_2$ is in the preferable range of 50 to 90%. Symbols j to m show the steels in which the contents of $Al_2O_3$ and $SiO_2$ satisfy the preferable requirements just as for the steels shown by the symbols f to i but in which non-metallic inclusions of Ti(C, N) system are scattered.

inclusions, the breakage numbers are extremely small compared to the steels not satisfying the preferable requirements.

Figure 1B:
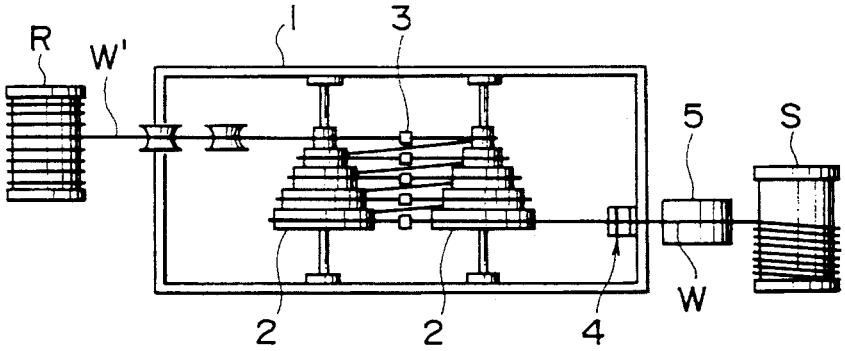
Figure 1C:
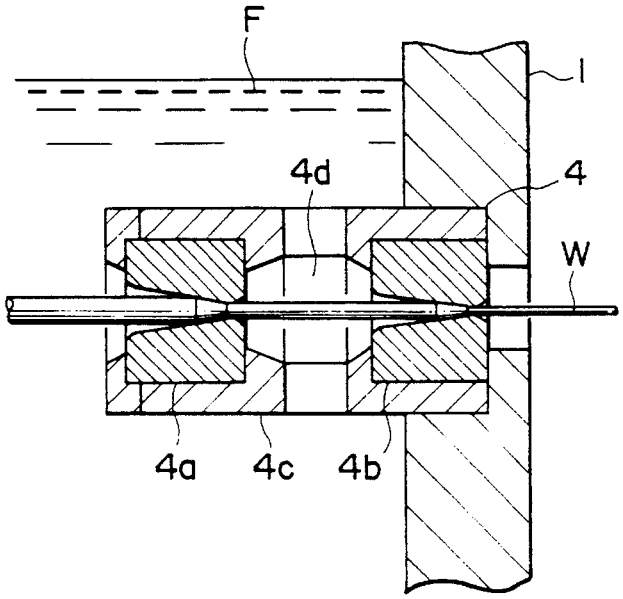
Figure 1D:
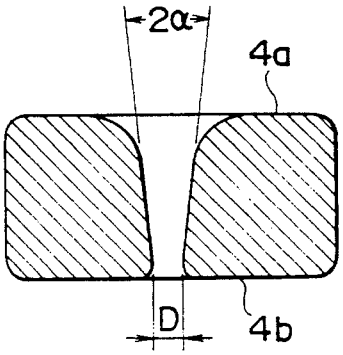

The wet-drawing method will be described below. FIGS. 1(*a*) to 1(*d*) show the outline of the construction of a wet-drawer used for obtaining a fine steel wire with a tensile strength (TS) of $2910-1275\times Log_{10}D$ [D(mm): wire diameter of fine steel wire] ($N/mm^2$) or more without any delamination, wherein FIG. 1(*a*) is a front sectional view; FIG. 1(*b*) is a top view; FIG. 1(*c*) is an explanatory sectional view of the main parts; and FIG. 1(*d*) is an explanatory sectional view of the finish die shape. The wet-drawer as shown in FIGS. 1(*a*) to 1(*d*) has the same construction as that conventionally used for drawing a fine steel wire except for the finish die to which the present invention is applied. In a drawing tank 1 filled with a lubricant mixed solution F, a plurality of (15 to 25 pieces) stepped wheel shaped capstans 2 and intermediate dies 3 are immersed. A finish die 4 is disposed on the outlet side wall portion of the drawing tank 1. In this wet-drawer, a filament W' fed from a supply reel R disposed on the upstream side is sequentially wound around each capstan 2, which is intermediately drawn by a group of intermediate dies 3 disposed between the capstans 2 in the lubricant mixed solution F. The filament W' is pulled through the finish die 4 by a winding capstan 5 disposed on the outlet side of the drawing tank 1, and is thus drawn to a fine steel wire W with a specified diameter. It is wound around a spooler S disposed on the downstream side of the winding capstan 5. Additionally, in the case of drawing a fine steel wire for use as a tire cord, since adhesion with rubber is required, the outlet side of the finish die 4 is air-cooled.

Further, as shown in FIG. 1(*c*), the finish die 4 in this embodiment is divided into a first finish die 4*a* and a second finish die 4*b* which are held by a die holder 4*c* having a solution passing portion at the intermediate portion thereof

TABLE 8

| | Composition of non-metallic inclusion of oxides (%) | | | | | | | Number of non-metallic inclusions of Ti(C, N) system with | Number of breakage in drawing into fine steel |
|---|---|---|---|---|---|---|---|---|---|
| Symbols | MgO | $Al_2O_3$ | $SiO_2$ | CaO | MnO | $TiO_2$ | Other components | diameter of 10 μm or more | wire (number/ton) |
| a | 7.2 | 34.2 | 36.9 | 7.9 | 11.7 | 0.8 | 1.3 | 0 | 15.8 |
| b | 5.9 | 35.8 | 37.1 | 8.1 | 10.6 | 0.6 | 1.8 | 0 | 16.5 |
| c | 3.9 | 48.0 | 30.0 | 5.8 | 7.9 | 0.9 | 3.5 | 0 | 39.3 |
| d | 2.1 | 10.5 | 76.5 | 3.6 | 5.0 | 0.5 | 1.8 | 0 | 9.0 |
| e | 2.3 | 15.8 | 71.4 | 5.0 | 3.9 | 0.7 | 0.9 | 0 | 8.5 |
| f | 5.9 | 24.2 | 43.4 | 19.1 | 5.1 | 5.3 | 1.4 | 0 | 0.8 |
| g | 1.8 | 16.3 | 50.2 | 1.9 | 23.6 | 2.0 | 4.2 | 0 | 0.7 |
| h | 3.8 | 20.0 | 47.5 | 8.3 | 18.0 | 1.7 | 0.7 | 0 | 1.3 |
| i | 5.3 | 21.2 | 46.3 | 15.3 | 10.3 | 0.9 | 0.7 | 0 | 1.0 |
| i | 5.2 | 20.8 | 43.6 | 17.8 | 9.1 | 1.3 | 2.2 | 3 | 10.0 |
| k | 3.9 | 21.3 | 46.3 | 8.6 | 18.1 | 0.9 | 0.9 | 4 | 18.0 |
| l | 1.9 | 19.0 | 48.3 | 1.8 | 23.5 | 3.3 | 2.2 | 3 | 15.3 |
| m | 3.8 | 20.3 | 40.2 | 15.1 | 18.0 | 1.8 | 0.8 | 10 | 31.3 |

Composition of non-metallic inclusions in the steel used in an experiment for controlling the composition of the inclusions; and the breakage rate during the process of drawing into a fine steel wire As is apparent from Table 8, in the steels shown by the symbols a to e and in the steels shown by the symbols j to m all of which are out of the range of the preferable requirements of the present invention, there often occur breakages of wires. In contrast, in the steels shown by the symbols f to i which satisfy the preferable requirements of the present invention even with respect to the non-metallic in a spaced apart manner, to thus form a double die structure. The second finish die 4*b* side is mounted on the outlet side of the inner wall of the drawing tank 1 and the first finish die 4*a* side is immersed in the lubricant mixed solution F. Namely, the inlet and outlet sides of the first finish die 4*a* and the inlet side of the second finish die 4*b* are wet-lubricated by the lubricant mixed solution F. Table 9 shows the mechanical properties of fine steel wires with a final wire diameter obtained by wet drawing under the following different sets of conditions: the approach angles of the first and second dies were both set at 12 degrees and the reduction of area of the second die was set at 4.5% or 12.7%; the approach angle of the second finish die was set at 4 degrees and the reduction of area of the second finish die was set at 4.5%; and then by adjusting the plated wire diameter, during plating, to give a wire with a tensile strength exceeding the value given by the equation $TS=2910-1275\times Log_{10}D$ [D(mm): wire diameter of fine steel wire] $N/mm^2$. As shown in this embodiment, in the case that each of the Inventive Examples E to U is wet-drawn under the condition that the approach angles of the first and second dies are each 12 degrees, and the reduction of area of the second finish die is 4.5%, a fine steel wire with the above tensile strength without any delamination can be obtained. Further, in the case that Comparative Example V is drawn under the condition that the approach angle of the first finish die is 12 degrees, the approach angle of the second finish die is 4 degrees, and the reduction of area of the second finish die is 4.5%, there can be obtained a fine steel wire with the above tensile strength without any delamination. As described above, in the case of using the Inventive Examples, the above drawing method is effective, and further, even when using steels other than Inventive Examples, the above drawing method makes it possible to obtain fine steel wires with excellent twisting characteristics in comparison with those drawn by the conventional wet-drawing method.

TABLE 9

| | Condition of second die of final finish die | | | Reduction of area: 4.5% | | | | | | | |
|---|---|---|---|---|---|---|---|---|---|---|---|
| | | | | Approach angle: 12° | | | | Approach angle: 4° | | | |
| Symbols | Wire diameter of plating wire (mm) | Wire diameter of fine steel wire (mm) | Total drawing reduction of area (%) | Tensile strength ($N/mm^2$) | Reduction of area (%) | Torsion value (number) *1 | Presence or absence of delamination | Tensile strength ($N/mm^2$) | Reduction of area (%) | Torsion value (number) *1 | Presence or absence of delamination |
| Inventive Example | | | | | | | | | | | |
| E | 1.5 | 0.23 | 97.6 | 3882 | 37 | 67 | Absence | 3955 | 36 | 69 | Absence |
| F | 1.5 | 0.23 | 97.6 | 3969 | 36 | 63 | Absence | 4077 | 36 | 62 | Absence |
| G | 1.4 | 0.23 | 97.3 | 3885 | 42 | 68 | Absence | 3953 | 38 | 67 | Absence |
| H | 1.4 | 0.23 | 97.3 | 3973 | 41 | 60 | Absence | 4043 | 39 | 62 | Absence |
| O | 1.5 | 0.23 | 97.6 | 3887 | 42 | 62 | Absence | 3984 | 38 | 61 | Absence |
| P | 1.5 | 0.23 | 97.6 | 3866 | 45 | 71 | Absence | 3966 | 39 | 68 | Absence |
| Q | 1.4 | 0.23 | 97.3 | 3952 | 43 | 62 | Absence | 4071 | 42 | 61 | Absence |
| R | 1.4 | 0.23 | 97.3 | 3927 | 42 | 62 | Absence | 4006 | 39 | 61 | Absence |
| S | 1.5 | 0.23 | 97.6 | 4055 | 34 | 58 | Absence | 4126 | 34 | 59 | Absence |
| T | 1.5 | 0.23 | 97.6 | 4068 | 34 | 59 | Absence | 4207 | 34 | 60 | Absence |
| U | 1.5 | 0.23 | 97.6 | 3850 | 39 | 63 | Absence | 3974 | 37 | 65 | Absence |
| Comparative Example V | 1.4 | 0.23 | 97.3 | 3968 | 33 | 32 | Presence | 4002 | 32 | 51 | Absence |

| | Reduction of area: 12.7% Approach angle: 12° | | | |
|---|---|---|---|---|
| Symbols | Tensile strength ($N/mm^2$) | Reduction of area (%) | Torsion value (number) *1 | Presence or absence of delamination |
| Inventive Example | | | | |
| E | 3925 | 38 | 22 | Presence |
| F | 4023 | 36 | 21 | Presence |
| G | 3906 | 36 | 22 | Presence |
| H | 4018 | 35 | 23 | Presence |
| O | 3954 | 33 | 44 | Absence |
| P | 3911 | 37 | 47 | Absence |
| Q | 4018 | 40 | 22 | Presence |
| R | 3981 | 39 | 24 | Presence |
| S | 4103 | 32 | 14 | Presence |
| T | 4119 | 31 | 17 | Presence |
| U | 3908 | 34 | 25 | Presence |
| Comparative Example V | 4003 | 28 | 13 | Presence |

*1 Torsion value: 200 dia converted value

In the present invention having the above construction, there can be obtained a steel wire rod with high strength, high corrosion resistance and good drawability. By drawing, patenting, brass-plating, and wet-drawing the above steel wire rod, it is possible to obtain a fine steel wire with high performance as a result of its excellent workability. Further, the fine steel wire does not break even during the twisting process, thereby forming a twisted wire cord with excellent strength and toughness, which can achieve the excellent performance as a reinforcing material for a tire, belt and cord. Accordingly, the present invention also contributes in reducing the weight of the tire.

We claim:

1. A hot-rolled steel wire rod used for manufacturing a fine steel wire consisting of:

C: 0.85–1.05 wt % (hereinafter, referred to as "%")

Si: 0.1–0.5%

Mn: 0.15–0.6%

P: 0.02% or less

S: less than 0.02%

Al: 0.003% or less

Cu: greater than 0.05% and less than 0.20%

Cr: 0.05–0.6%, and the balance being essentially Fe and inevitable impurities;

wherein the contents of Cr, Si and Cu satisfy the following equation:

$$1.0 \leqq (Cr\%+Si\%)/Cu\% \leqq 4.0; \text{ and}$$

wherein the hot-rolled steel wire rod has a total scale amount after hot-rolling of from 0.30 to 0.50%.

2. A hot-rolled steel wire rod according to claim 1, which further contains W: 0.05–0.4%.

3. A hot-rolled steel wire rod according to claim 1, wherein the center line average roughness (Ra) on the surface of said steel wire rod after descaling with an applied tensile strain of 4% is specified to be 0.55 μm or less.

4. A hot-rolled steel wire rod used for manufacturing a fine steel wire consisting of:

C: 0.85–1.05 wt % (hereinafter, referred to as "%")

Si: 0.1–0.5%

Mn: 0.15–0.6%

P: 0.02% or less

S: less than 0.02%

Al: 0.003% Or less

Cu: greater than 0.05% and less than 0.20%

Cr: 0.05–0.6%, and the balance being essentially Fe and inevitable impurities;

wherein the contents of Cr, Si and Cu satisfy the following equation:

$$1.0 \leqq (Cr\%+Si\%)/Cu\% \leqq 4.0; \text{ and}$$

wherein the hot-rolled steel wire rod has a total scale amount after hot-rolling of from 0.30 to 0.50%, wherein non-metallic inclusions of oxides contained in said steel wire rod consist of inclusions mainly containing MgO, $SiO_2$, $Al_2O_3$, MnO, CaO and $TiO_2$ in which the average composition of said non-metallic inclusions of oxides is specified in that the content of $Al_2O_3$ is 30% or less; the content of $SiO_2$ is 70% or less; the total content of $Al_2O_3$ and $SiO_2$ is in the range of from 50 to 90%; and the balance is MgO, CaO and $TiO_2$, and further, said steel wire rod contains no microscopically observable non-metallic inclusions of Ti(C,N) system with diameters of 10 μm or more.

5. A fine steel wire obtained by drawing, final heat-treatment, plating and wet-drawing of said steel wire rod, which satisfies said composition according to claim 1 or 2, and has a diameter of 0.35 mm or less and has a tensile strength of the value of $2650-1275 \times Log_{10}D$ [D(mm): wire diameter of the fine steel wire] ($N/mm^2$) or more.

6. A twisted steel wire obtained by twisting of said fine steel wires according to claim 5.

7. The hot-rolled steel wire rod as claimed in claim 1, wherein S is present in an amount of 0.013% or less.

8. The hot-rolled steel wire rod as claimed in claim 1, wherein S is present in an amount of 0.01% or less.

* * * * *